US012065754B2

(12) United States Patent
Molls et al.

(10) Patent No.: US 12,065,754 B2
(45) Date of Patent: Aug. 20, 2024

(54) METHOD FOR PASSIVATING THE SURFACE OF A TINPLATE AND ELECTROLYSIS SYSTEM FOR CARRYING OUT THE METHOD

(71) Applicant: thyssenkrupp Rasselstein GmbH, Andernach (DE)

(72) Inventors: Christoph Molls, Bonn (DE); Birgit Bergholz, Mendig (DE); Gerhard Menzel, Bell (DE)

(73) Assignee: thyssenkrupp Rasselstein GmbH, Andernach (DE)

( * ) Notice: Subject to any disclaimer, the term of this patent is extended or adjusted under 35 U.S.C. 154(b) by 0 days.

(21) Appl. No.: 17/958,551

(22) Filed: Oct. 3, 2022

(65) Prior Publication Data

US 2023/0109499 A1 Apr. 6, 2023

(30) Foreign Application Priority Data

Oct. 4, 2021 (DE) ..... 10 2021 125 696.8

(51) Int. Cl.
*C25D 3/06* (2006.01)
*C25D 7/06* (2006.01)
(Continued)

(52) U.S. Cl.
CPC ..... *C25D 3/06* (2013.01); *C25D 7/0614* (2013.01); *C25D 9/08* (2013.01); *C25D 17/02* (2013.01)

(58) Field of Classification Search
CPC ..... C25D 9/08–12
See application file for complete search history.

(56) References Cited

U.S. PATENT DOCUMENTS 6,068,755 A * 5/2000 Matsuda ..... C25D 5/627 205/333
11,401,621 B2 8/2022 Marmann
(Continued)

FOREIGN PATENT DOCUMENTS

DE 10 2019 109 354 A1 10/2020
DE 10 2019 109 356 A1 10/2020
(Continued)

OTHER PUBLICATIONS

Fousse et al, Machine Translation and Original, FR 2687693 A1 (Year: 1993).*
(Continued)

*Primary Examiner* — Hosung Chung
(74) *Attorney, Agent, or Firm* — Paul D. Bianco; Katharine Davis Wong; Fleit Intellectual Property Law

(57) ABSTRACT

In a method for passivating the surface of a tinplate using electrolytic deposition of a passivation layer containing chromium oxide/chromium hydroxide on the surface, the electrolytic deposition of the passivation layer is carried out at least partly from an electrolyte solution which contains a trivalent chromium compound, at least one salt for increasing the conductivity and at least one acid or one base for adjusting a desired pH value and is free from organic complexing agents and free from buffering agents. In order to increase the amount of chromium oxide in the passivation layer, after the electrolytic deposition of the passivation layer, the passivated tinplate is subjected to a thermal treatment in which the passivated tinplate is kept at a treatment temperature of 100° C. or more for a treatment time of at least 0.5 seconds.

14 Claims, 4 Drawing Sheets

(51) Int. Cl.
*C25D 9/08* (2006.01)
*C25D 17/02* (2006.01)

(56) References Cited

U.S. PATENT DOCUMENTS

| | | | | |
|---|---|---|---|---|
| 2016/0002748 | A1* | 1/2016 | Oberhoffer | C21D 6/004 148/525 |
| 2020/0325590 | A1* | 10/2020 | Marmann | C25D 3/06 |
| 2020/0325591 | A1 | 10/2020 | Marmann | |

FOREIGN PATENT DOCUMENTS

| | | | | |
|---|---|---|---|---|
| EP | 3 722 464 | A1 | 10/2020 | |
| FR | 2687693 | A1 | 8/1993 | |
| JP | 2020-172701 | A | 10/2020 | |
| WO | 2014/06031 | A1 | 1/2014 | |
| WO | WO-2014006031 | A1 * | 1/2014 | C23C 22/76 |
| WO | 2015/177314 | A1 | 11/2015 | |
| WO | 2015/177315 | A1 | 11/2015 | |

OTHER PUBLICATIONS

Schroeder et al., Original and Machine Translation, EP-0580273-A1 (Year: 1994).*
Result of examination report for German Patent Application No. 10 2021 125 696.8, filed Oct. 4, 2021.
Jandel, et al., Coil Coating—2013, ISBN 978-3-8348-2354-0 (62 pages, English translation included).
Japanese Office Action dated Nov. 21, 2023, for Japanese Application No. 2022-155876.

* cited by examiner

Table 2

| | Electrolysis | | | thermal treatment | | Climate chamber (CS) (40°C, 80%) | | | | |
|---|---|---|---|---|---|---|---|---|---|---|
| Sample no. | j [A/dm$^2$] | t [sec] | Cr [mg/m$^2$] | T [°C] | τ [sec] | $SnO_2$ [C/m²] before CS | $SnO_2$ [C/m²] after 2 weeks | $SnO_2$ [C/m²] after 4 weeks | $SnO_2$ [C/m²] after 6 weeks | Δ $SnO_2$ [C/m²] (6 Weeks) |
| 1a (comparison sample) | 2 | 0.5 | 4 | - | - | 19 | 64 | 65 | 70 | 51 |
| 1b (comparison sample) | 2 | 0.5 | 3 | - | - | 18 | 60 | 54 | 48 | 30 |
| 1c (according to the invention) | 2 | 0.5 | 5 | 200 | 600 | 29 | 42 | 44 | 47 | 18 |
| | | | | | | | | | | |
| 2a (comparison sample) | 2 | 1 | 11 | - | - | 19 | 37 | 77 | 59 | 40 |
| 2b (comparison sample) | 2 | 1 | 11 | - | - | 13 | 34 | 32 | 38 | 25 |
| 2c (according to the invention) | 2 | 1 | 10 | 200 | 600 | 14 | 20 | 20 | 25 | 11 |
| | | | | | | | | | | |
| 3a (comparison sample) | 2 | 0.8 | 15 | - | - | 8 | 49 | 76 | 108 | 100 |
| 3b (according to the invention) | 2 | 0.8 | 11 | 200 | 600 | 8 | 26 | 37 | 38 | 30 |
| | | | | | | | | | | |
| 4a (comparison sample) | 2 | 0.8 | 8 | - | - | 15 | 53 | 54 | 74 | 59 |
| 4b (according to the invention) | 2 | 0.8 | 9 | 200 | 600 | 19 | 28 | 37 | 44 | 25 |

j: current density, t: electrolysis time, Cr: chromium support;
T: treatment temperature of thermal treatment, τ : treatment time of thermal treatment;
$SnO_2$ before CS: Tin oxide deposit before being placed in the climate chamber (CS);
$SnO_2$ after 2/4/6 weeks.: Tin oxide deposition 2/4/6 weeks after placement in the climate chamber;
Δ $SnO_2$: tin oxide growth during storage in climate chamber

Fig. 3

Table 3

| | Electrolysis | | | thermal treatment | | Climate chamber (CS) (40°C, 80%) | | | |
|---|---|---|---|---|---|---|---|---|---|
| Sample no. | j [A/dm$^2$] | t [sec] | Cr [mg/m$^2$] | T [°C] | τ [sec] | $SnO_2$ [C/m²] before CS | $SnO_2$ [C/m²] after 2 weeks | $SnO_2$ [C/m²] after 4 weeks | Δ $SnO_2$ [C/m²] (4 weeks) |
| 1 (comparison sample) | 37 | 0.2 | 9 | - | - | 11 | 44 | 60 | 49 |
| 2 (according to the invention) | 37 | 0.2 | 9 | 187 | 10 | 9 | 38 | 55 | 46 |
| 3 (according to the invention) | 37 | 0.2 | 9 | 187 | 30 | 7 | 28 | 46 | 39 |
| 4 (according to the invention) | 37 | 0.2 | 9 | 187 | 60 | 8 | 26 | 39 | 31 |
| 5 (according to the invention) | 37 | 0.2 | 9 | 187 | 120 | 9 | 21 | 37 | 28 |

j: current density, t: electrolysis time, Cr: chromium support;
T: treatment temperature of thermal treatment, τ : treatment time of thermal treatment;
$SnO_2$ before CS: Tin oxide deposit before being placed in the climate chamber (CS);
$SnO_2$ after 2/4 weeks: Tin oxide deposit 2/4 weeks after placement in the climate chamber;
Δ $SnO_2$: tin oxide growth during storage in climate chamber

Fig. 4

METHOD FOR PASSIVATING THE SURFACE OF A TINPLATE AND ELECTROLYSIS SYSTEM FOR CARRYING OUT THE METHOD

FIELD OF THE INVENTION

The invention relates to a method for passivating the surface of a tinplate by electrolytic deposition of a chromium oxide-containing passivation layer on the surface of the tinplate, and to an electrolysis system for electrolytically depositing a chromium oxide-containing passivation layer on the surface of a tinplate.

Steel sheets electrolytically coated with a passivation layer of chromium and chromium oxide/chromium hydroxide are known from the state of the art for the production of packagings. These are known as tin-free steel (TFS) or electrolytic chromium coated steel (ECCS) and represent an alternative to tinplate. These tin-free steel sheets are particularly characterized by good adhesion to lacquers or organic coatings (such as polymer coatings made of PP or PET). Despite the low thickness of the passivation layer of chromium and chromium oxide/chromium hydroxide, which generally is less than 20 nm, these chromium-coated steel sheets exhibit good corrosion resistance and good formability in forming processes, e.g. in deep-drawing and draw-and-wall ironing processes, for the production of packagings.

Tin-plated steel sheets (tinplate) are usually provided with a passivation layer after electrolytic tinning to prevent oxidation of the tin surface to atmospheric oxygen. Suitable passivation layers have proven to be chromium-containing layers that can be deposited electrolytically from an electrolyte containing chromium (VI) on the tin surface of tinplate. These chromium-containing passivation layers are composed of metallic chromium and chromium oxides. Chromium oxide here is understood to comprise all compounds of chromium and oxygen, including chromium hydroxides.

For the production of electrolytic chromium-coated steel sheets (ECCS) and for the passivation of tinplate surfaces, electrolytic coating methods are known from the prior art, with which a passivation layer containing metallic chromium and chromium oxide/chromium hydroxide can be applied to a strip-shaped substrate (uncoated steel sheet or tinplate) in a strip coating line using an electrolyte containing chromium-VI. However, these coating methods have considerable disadvantages due to the environmentally and health hazardous properties of the chromium-VI containing electrolytes used in the electrolysis method and will have to be replaced by alternative coating methods in the foreseeable future, as the use of materials containing chromium-VI will be banned in the future.

For this reason, electrolytic coating methods have already been developed in the state of the art that can dispense with the use of electrolytes containing chromium-VI. For example, a method for the electrolytic passivation of a strip-shaped steel sheet, in particular a strip-shaped blackplate or tinplate, with a chromium metal-chromium oxide (Cr—CrOx) layer is known from WO 2015/177314-A1 and WO 2015/177315-A1, in which the steel sheet, connected as cathode in a strip coating line, is passed at high strip speeds of more than 100 m/min through a single electrolyte solution which contains a trivalent chromium compound (in particular Cr-III sulfate) as well as a complexing agent and a conductivity-increasing salt and is free from chlorides and buffering agents such as boric acid.

Organic substances, in particular formates and preferably sodium or potassium formate, are used as complexing agents. To set a preferred pH value in the range from 2.5 to 3.5, the electrolyte solution can contain sulfuric acid. The passivation layer of chromium metal and chromium oxide can be deposited in layers in successive electrolytic tanks or in successive coil coating lines, the electrolytic tanks each being filled with the same electrolyte solution.

It was observed that the electrolytically deposited passivation layer can also contain chromium sulfates and chromium carbides in addition to the components chromium metal and chromium oxide/chromium hydroxide, and that the proportions of these components in the total coating weight of the passivation layer depend quite substantially on the current densities set in the electrolytic tanks. It was found that three ranges (regime I, regime II and regime III) are formed as a function of the current density, whereby in a first range (regime I) with low current density up to a first current density threshold no chromium-containing deposition occurs on the steel substrate yet, in a second range (regime II) with medium current density, there is a linear relationship between the current density and the coating weight of the deposited passivation layer, and at current densities above a second current density threshold (regime III), partial decomposition of the applied passivation layer takes place, so that the coating weight of the chromium of the passivation layer in this regime initially drops with increasing current density and then settles to a constant value at higher current densities. Here, in the region with medium current density (regime II), essentially metallic chromium is deposited on the steel substrate with a weight fraction of up to 80% (based on the total weight of the passivation layer), and above the second current density threshold (regime III), the passivation layer contains a higher fraction of chromium oxide, which in the region of higher current densities accounts for between ¼ and a ⅓ of the total coating weight of the passivation layer. The values of the current density thresholds that delimit the ranges (regimes I to III) from one another depend on the strip speed at which the steel sheet is moved through the electrolyte solution.

For good passivation of a tinplate surface against oxidation in an oxygen-containing environment and for the formation of a good adhesion of organic coatings such as lacquers or thermoplastics, in particular for the lamination of plastic films made of PET, PP, PE or mixtures thereof, the highest possible proportion of chromium oxide in the chromium-containing passivation layer is advantageous.

From EP 3 722 464 A1 a method for passivating the surface of a tinplate by deposition of a passivation layer consisting at least essentially only of chromium oxide and chromium hydroxide is known, wherein for this purpose an aqueous solution of an electrolyte with a trivalent chromium compound is used which contains no organic substances and in particular no organic complexing agents. Due to the use of an aqueous electrolyte solution, the deposited passivation layer has a high chromium hydroxide content in addition to chromium oxide. However, the chromium hydroxide content of the passivation layer allows atmospheric oxygen to diffuse through the passivation layer when the passivated tinplate is stored in an air atmosphere for a long period of time. Due to the diffusion of atmospheric oxygen through the passivation layer, a harmful tin oxide layer is formed on the tin surface of the tinplate, consisting essentially of divalent tin oxide (SnO).

SUMMARY

One aspect of the present invention therefore relates to an efficient, cost-effective electrolysis method for passivating the surface of a tinplate with a chromium-oxide containing passivation layer based on an electrolyte solution with a trivalent chromium compound, which is capable of preventing the growth of a tin oxide layer on the tin surface of the tinplate in an atmosphere containing oxygen or air. In any case, the use of substances containing chromium-VI, also as intermediate products of the electrolysis method, is to be avoided in order to be able to fully comply with the legal requirements regarding the prohibition of substances containing chromium-VI. The tinplate coated according to the method should have the highest possible resistance to oxidation in oxygen-containing environments, in particular in atmospheric oxygen, and should have good adhesive properties for organic coatings, such as organic lacquers, and polymer coatings, in particular polymer films made, for example, from PET, PE or PP.

In the method according to the invention, a chromium-oxide containing passivation layer is electrolytically deposited from an electrolyte solution which contains a trivalent chromium compound as well as at least one salt for increasing the conductivity and at least one acid or one base for adjusting a desired pH value and is free from organic complexing agents and free from buffering agents, onto a tin-plated steel strip (tinplate strip), wherein after the electrolytic deposition of the passivation layer the passivated tinplate is subjected to a thermal treatment in which the passivated tinplate is kept at a treatment temperature of 100° C. or more for a treatment time of at least 0.5 seconds. The thermal treatment of the passivated tinplate is performed immediately after the electrolytic deposition of the passivation layer and removes the chromium hydroxide components contained in the passivation layer from the passivation layer. This makes the passivation layer impermeable to oxygen, which can prevent the growth of a tin oxide layer on the tin surface of the tinplate. In the case of tinplate which has been thermally treated in accordance with the invention after deposition of the passivation layer, a tin oxide layer with a tin oxide overlay of less than 70 $C/m^2$ is present under the passivation layer after storage for at least four weeks in an oxygen-containing atmosphere. Preferably, the overlay of the tin oxide layer after at least four weeks of storage is less than 55 $C/m^2$ and is more preferred less than 40 $C/m^2$ and especially in the range of 20 $C/m^2$ to 60 $C/m^2$. The entire overlay of the tin oxide layer can thereby be composed of divalent tin oxide (SnO), which is produced by natural oxidation of the tin surface in atmospheric oxygen, and of tetravalent tin oxide ($SnO_2$), which is produced by a targeted anodic oxidation prior to the electrolytic deposition of the passivation layer. Preferably, the tetravalent tin oxide has an overlay of less than 40 $C/m^2$ and even more preferred of less than 30 $C/m^2$.

No substances containing chromium VI are used in the process according to the invention, not even as intermediates, so that the process is completely free of substances containing chromium VI and thus does not harm the environment or human health when the process is carried out.

Due to the use of an electrolyte solution free of organic complexing agents, which in particular does not contain any formates, for the electrolytic deposition of the passivation layer or at least of an upper layer of the passivation layer and due to the subsequent thermal treatment of the tinplate provided with the passivation layer, the passivation layer, apart from unavoidable impurities (which may in particular be residues of chromium hydroxide as well as chromium sulfates if Cr(III) sulfate is used as a trivalent chromium compound in the electrolytic solution), consists at least essentially of pure chromium oxide or it contains at least one upper layer of pure chromium oxide. The passivation layer consisting of pure chromium oxide or the upper layer of the passivation layer forms on the one hand a very good barrier to the penetration of oxygen and on the other hand provides a good adhesion for organic coatings, such as organic lacquers or polymer films made from PET, PP or PE.

When referring to chromium oxide, all (trivalent) oxide forms of chromium (CrOx) are meant. When referring to chromium hydroxide, all hydrated forms of chromium oxide are meant, in particular chromium-(III) hydroxide and chromium-(III) oxide hydrate, as well as mixtures thereof.

After thermal treatment according to the invention, the electrolytically applied passivation layer has a chromium oxide content by weight as high as possible. Preferably, the weight fraction of chromium oxide is more than 95%. On the one hand, this ensures good passivation against oxidation of the surface of the tinplate and, on the other hand, provides good properties for organic coatings such as organic lacquers or polymer layers made of thermoplastics such as PET; PE or PP.

For electrolytic deposition of the passivation layer, the tinplate strip is connected as a cathode and brought into contact with the electrolyte solution in at least one electrolytic tank for a predetermined electrolysis time. The electrolysis time is preferably in the range from 0.3 to 5.0 seconds and particularly preferably between 0.6 and 1.5 seconds. For this purpose, the tinplate strip is passed at a predetermined speed through at least one electrolytic tank or successively through several electrolytic tanks arranged one behind the other in the running direction of the strip, the strip speed preferably being at least 100 m/min and even more preferred between 200 m/min and 750 m/min. The high speeds can ensure a high efficiency of the method.

The thickness or coating weight of the electrolytically deposited passivation layer can be controlled via the electrolysis time and thus via the strip speed. Preferably, the electrolysis time is selected so that the deposited chromium oxide has a coating weight of at least 3 $mg/m^2$ and preferably from 8 $mg/m^2$ to 12 $mg/m^2$, in terms of chromium. These preferred coating weights of the passivation layer result in sufficient oxidation and corrosion resistance of the tinplate for packaging applications and also provide a good adhesion base for organic coatings such as lacquers or thermoplastic films.

In order to improve the corrosion resistance and to form a barrier against sulfur-containing materials, in particular against sulfate- or sulfite-containing contents of packagings, it is therefore possible, after the electrolytic application of the passivation layer, to apply a coating of an organic material that adheres well to the chromium oxide layer of the passivation layer, in particular a coating of a thermoplastic, in particular a polymer film of PET, PE, PP or a mixture thereof, by coating the surface of the passivation layer with an organic coating or providing it with a plastic layer of a thermoplastic such as PET, PP and/or PE.

In order to ensure that the method is completely free of chromium-VI containing substances, a suitable anode is selected for the electrolytic deposition of the passivation layer and arranged in the electrolytic tank or each of the electrolytic tanks to prevent oxidation of chromium-(III) from the trivalent chromium compound of the electrolyte solution to chromium-(VI). Steel-free and stainless steel-free anodes with an outer surface or a passivation layer of a metal oxide, in particular iridium oxide, or of a mixed metal oxide, in particular iridium-tantalum oxide, have proved particularly suitable for this purpose. Preferably, the anode contains neither stainless steel nor platinum. By using such anodes, coatings can be deposited on the tinplate which contain only trivalent chromium oxides and/or chromium hydroxides, in particular $Cr_2O_3$ and/or $Cr(OH)_3$.

To carry out the method according to the invention, an electrolysis system can be used which comprises:

at least one electrolyte tank filled with a first electrolyte solution, or a plurality of electrolyte tanks arranged in series, of which at least one electrolyte tank is filled with the first electrolyte solution and the remaining electrolyte tanks are filled with the first electrolyte solution or another electrolyte solution which contains a trivalent chromium compound and whose composition is different from the first electrolyte solution, wherein the first electrolyte solution contains a trivalent chromium compound as well as at least one salt for increasing the conductivity and at least one acid or one base for adjusting a desired pH value and is free from organic complexing agents as well as free from buffering agents, a transport device for transporting a strip-shaped tinplate in a running direction at a predetermined speed, which is preferably more than 100 m/min, through the at least one electrolytic tank or successively through the plurality of electrolytic tanks, for the electrolytic deposition of a passivation layer from the first electrolytic solution and optionally the other electrolytic solution on the surface of the tinplate, a heating device arranged downstream of the electrolytic tank or tanks or downstream of the plurality of the electrolytic tanks in the running direction and designed to heat the passivated tinplate to a predetermined treatment temperature of at least 100° C. for a predetermined treatment time of at least 0.5 seconds.

In one embodiment, the electrolysis system according to the invention comprises several electrolytic tanks arranged in series, of which at least the last electrolytic tank, viewed in the running direction of the strip, is filled with the first electrolyte solution and the preceding electrolytic tanks are filled with another electrolyte solution which, in addition to the trivalent chromium compound, contains at least one salt to increase the conductivity and at least one acid or base to set a desired pH value, as well as organic complexing agents. In particular, formates and preferably sodium or potassium formate can be used as complexing agents. The temperatures of the electrolyte solutions in the individual electrolyte tanks can also be selected differently. This embodiment permits the deposition of a chromium oxide-containing passivation layer on the surface of the tinplate with several layers having different compositions.

In particular, this embodiment of the electrolysis system can be used to produce a passivation layer with a lower layer of metallic chromium and chromium oxide/chromium hydroxide and possibly chromium carbides and an upper layer of pure chromium oxide. The individual layers of the passivation layer are deposited on the tin surface of the tinplate in the individual electrolytic tanks of the electrolysis system arranged one behind the other. The differences in the composition and/or temperature of the electrolyte solutions in the individual electrolytic tanks result in the different compositions of the layers of the passivation layer, which differ from one another in particular in the proportion by weight of the chromium oxide.

The heating device can be used to convert the chromium hydroxide components of the passivation layer or at least the chromium hydroxide components in the upper layer of the passivation layer into chromium oxide, so that the passivation layer either consists entirely of pure chromium oxide or at least the upper layer of the passivation layer contains essentially only chromium oxide and in particular has no metallic chromium and at most unavoidable residual chromium hydroxide. The heating device is preferably arranged immediately downstream of the electrolytic tank or downstream of the last electrolytic tank of the plurality of electrolytic tanks, viewed in the running direction of the strip. This enables the thermal treatment of the passivation layer to be carried out immediately at a short time interval of, for example, less than 10 seconds after completion of the electrolytic application of the passivation layer.

The electrolysis system according to the invention can expediently be arranged immediately downstream of an electrolytic tinning line in which the steel sheet substrate of the tinplate is electrolytically provided with a tin layer. Thus, application of the passivation layer to the tin surface of the tinplate can take place directly after the electrolytic tinning of the steel sheet substrate, without the tinplate strip having to be wound up. The steel sheet substrate of the tinplate, which is fed through the tinning line as a steel strip at a predetermined strip speed for tinning, can therefore be fed further through the electrolysis system according to the invention at the same strip speed directly after tinning by means of the transport device. However, it is also possible to first wind the tinned steel strip into a coil and to feed the coil to the transport device of the electrolysis system according to the invention for unwinding and transporting the tinplate strip.

The heating device may be designed as a continuous furnace with a heating section having a preferred length of at least 3 m. The heating device may also comprise an induction heater. The electrolysis system according to the invention can also include a further heating device which, viewed in the running direction of the strip, is arranged upstream of the (first) electrolytic tank or upstream of the plurality of electrolytic tanks. This further heating device, which is preferably designed as an induction heater, can be used to at least partially melt the tin layer of the tinplate applied in the tinning line by heating the tinplate strip in the further heating device to temperatures above the melting point of tin.

The electrolyte solution preferably has an electrolyte temperature in the range from 20° C. to 80° C. and particularly preferably in the range from 30° C. to 65° C. and especially between 40° C. and 60° C. At these temperatures, electrolytic deposition of the chromium-oxide containing passivation layer is very efficient. When the electrolyte temperature or the temperature of the electrolyte solution or the temperature in an electrolytic tank is referred to, in each case the mean temperature averaged over the entire volume of the electrolytic tank is meant. As a rule, there is a temperature gradient in the electrolyte tank with a temperature increase from top to bottom. When multiple electrolyte tanks are used, the electrolyte temperature in each electrolyte tank may be different, which can affect the composition of the layers of passivation layer deposited in each electrolyte tank. For example, at electrolyte temperatures lower than 40° C., a layer with a higher chromium oxide content is deposited compared to electrolyte tanks with a higher electrolyte temperature. It is therefore advantageous in the method according to the invention to set an electrolyte temperature of 40° C. or less in the last electrolyte tank in order to maximize the chromium oxide content in the upper layer of the passivation layer.

The first electrolyte solution, which is filled in at least one and preferably in the last electrolyte tank as seen in the running direction, contains, in addition to the trivalent chromium compound and the solvent water, at least one conductivity-increasing salt and at least one acid or base for setting a suitable pH value and is preferably free of chloride ions and free of buffering agents, in particular free of a boric acid buffer.

The trivalent chromium compound of the electrolyte solution is preferably selected from the group comprising basic Cr(III) sulfate ($Cr_2(SO_4)_3$), Cr(III) nitrate ($Cr(NO_3)_3$), Cr(III) oxalate ($CrC_2O_4$), Cr(III) acetate ($C_{12}H_{36}ClCr_3O22$), Cr(III) formate ($Cr(OOCH)_3$) or a mixture thereof. The concentration of the trivalent chromium compound in the electrolyte solution is preferably at least 10 g/L and particularly preferably more than 15 g/L and especially 20 g/L, or more.

To increase conductivity, the electrolyte solution contains at least one salt, which is preferably an alkali metal sulfate, in particular potassium or sodium sulfate.

Very efficient deposition of a passivation layer containing chromium oxide and chromium hydroxide is achieved when the pH (measured at a temperature of 20° C.) of the electrolyte solution is in a range from 2.3 to 5.0 and preferably between 2.5 and 3.5. The desired pH can be adjusted by adding an acid or base to the electrolyte solution. When basic Cr(III) sulfate is used as the trivalent chromium compound, sulfuric acid or an acid mixture containing sulfuric acid is particularly suitable for adjusting the desired pH.

Particularly preferred compositions of the electrolyte solution each include basic Cr(III) sulfate ($Cr_2(SO_4)_3$) as a trivalent chromium compound, as well as sodium sulfate as a conductivity-increasing salt and sulfuric acid for setting a preferred pH in the range of 2.5 to 3.5.

In addition to the trivalent chromium-containing substance, the at least one salt for increasing the conductivity and the at least one acid or base for adjusting the pH value, the electrolyte solution contains no other components apart from the solvent water. This ensures simple and inexpensive preparation of the electrolyte solution and leads to deposition of a passivation layer which, at least substantially, consists only of chromium oxide and chromium hydroxide and otherwise contains only unavoidable impurities, such as chromium sulfates, if Cr-(III) sulfate is used as the trivalent chromium compound.

In the method according to the invention, the chromium hydroxide components contained in the electrodeposited passivation layer are removed from the passivation layer by subjecting the passivated tinplate to a thermal treatment, wherein the passivated tinplate is kept at a treatment temperature of 100° C. or more for a treatment time of at least 0.5 seconds. As a result, the water of the hydrated chromium oxides evaporates and the chromium hydroxides are converted into chromium oxides.

The treatment time is preferably between 0.5 seconds and 30 minutes and even more preferred between 1.0 seconds and 1 minute. The treatment temperatures are preferably between 150° C. and the melting temperature of tin (232° C.) to prevent melting of the tin surface of the tinplate. In particular, the thermal treatment is carried out immediately after the electrolytic deposition of the passivation layer on the tinplate strip by passing the tinplate strip through a furnace at the strip speed at which the tinplate strip is passed through the electrolytic tank(s). At the high strip speeds of preferably more than 100 m/min and up to 900 m/min, very short treatment times of a few seconds or even less than one second result, depending on the length of the furnace in the running direction of the strip, which length is preferably between 5 and 30 m. For very short treatment times of 1 second or less, higher treatment temperatures are selected, which can be between 170° C. and 230° C., for example. Very short treatment times of one second or less are also sufficient for lower treatment temperatures of below 150° C. if the temperature of the electrolyte in the last electrolyte tank viewed in the direction of strip running is relatively high, e.g. in the range of 50° C. or more, because the passivated tinplate strip then has this temperature and only needs to be heated to the (maximum) treatment temperature for thermal treatment within a short time.

Particularly fast and efficient heating of the passivated tinplate to the (maximum) treatment temperature can be achieved by inductive heating in an induction coil. Heating rates of 100 K/s to 700 K/s can be achieved, with which the passivated tinplate can be heated from the electrolyte temperature of the last electrolyte tank to the (maximum) treatment temperature.

However, it is also possible to carry out the thermal treatment of the passivated tinplate, if necessary after cutting the tinplate strip into sheets, in an oven or by means of IR irradiation of the passivated tinplate. Longer treatment times of several minutes can be selected by using an oven, whereby lower treatment temperatures in the range of 100° C. to 150° C. can be used.

In order to prevent oxygen from diffusing through the still moist passivation layer after deposition of the passivation layer, the thermal treatment is preferably carried out immediately after the electrolytic deposition of the passivation layer, i.e. directly after leaving the last electrolyte tank. Between the completion of the deposition of the passivation layer, i.e. leaving the last electrolytic tank, and reaching the treatment temperature, there is preferably an intermediate time of at most 10 seconds.

In a preferred embodiment of the method, a tin oxide layer consisting essentially of tetravalent tin oxide ($SnO_2$) is produced on the surface of the tinplate prior to the electrolytic deposition of the passivation layer by placing the tinplate as anode in an aqueous and, in particular, basic electrolyte containing a phosphate, borate, sulfate or carbonate. The formation of a tetravalent tin oxide layer, which is more inert to further oxidation in an oxygen atmosphere than divalent tin oxide, minimizes unhindered growth of the oxide layer on the tin surface of the tinplate in an oxygen-containing atmosphere and improves the marbling resistance of the tinplate to sulfur-containing substances, such as sulfur-containing contents of packagings made from the tinplate. On the one hand, the stoichiometry of the tin oxide layer and the ratio of divalent and tetravalent tin oxide can be controlled by the targeted anodic oxidation, and on the other hand a homogeneous distribution of the tin oxide layer on the surface of the tinplate is achieved.

The anodic oxidation is expediently carried out in the electrolysis line in which the electrolytic application of the passivation layer takes place, i.e. the tinplate strip is passed through a first electrolytic tank, which is connected upstream of the electrolytic tanks with the trivalent chromium electrolyte solution and is filled with the basic electrolyte, before the electrolytic application of the passivation layer in the electrolysis system according to the invention is performed. The tinplate strip is thereby connected in the electrolytic tank with the basic electrolyte as anode and in the subsequent electrolytic tanks with the trivalent chromium electrolyte solution as cathode.

The basic electrolyte, which may be, for example, an aqueous sodium carbonate solution with a concentration in the range from 1 wt. % to 10 wt. %, preferably has a temperature in the range from 30 to 60° C. and a pH value in the range from 7 to 11 and, in the case of sodium carbonate in particular, between 10 and 11. The current density in the first electrolytic tank, where the anodic oxidation takes place, is preferably in the range of 0.1 to 10 $A/dm^2$ and particularly preferably between 0.2 and 3 $A/dm^2$. The anodization time, i.e. the time during which the tinplate is electrolytically effectively in contact with the basic electrolyte, is preferably less than 5 seconds and preferably in the range of 0.1 to 1.0 seconds and can be suitably adapted to the strip speed at which the tinplate strip is passed through the electrolysis system.

As a result of the anodic oxidation, a tin oxide layer ($SnO_2$) is applied to the still unpassivated tin surface of the tinplate, which preferably has a coating weight in the range from 10 to 40 $C/m^2$ and particularly preferred of less than 30 $C/m^2$ and especially between 10 and 28 $C/m^2$, corresponding to a thickness of a few nm. The overlay of the tin oxide layer on a sample can be determined coulometrically in a chronoamperometric measuring method by measuring the applied tin oxide layer with a working electrode made of the material to be measured and previously degreased, a counter electrode made of a carbon rod and an Ag/AgCl reference electrode in a 47% hydrobromic acid (HBr) diluted to a 0.01 n solution (0.01 mol/l) in water and completely deaerated with an inert gas (e.g. $N_2$), is reduced from the tinplate sample and the amount of charge in Coulombs (determined from the product of the cathode current A and the reduction time t) required for complete reduction of the tin oxide layer at a current density in the range of 0.5 to 0.7 $A/m^2$ is recorded, where the charge per unit area in $C/m^2$ is obtained from the quotient of the amount of charge in Coulombs (C) and the area of the sample (in $m^2$) (acc. to ANNEX D to the draft European standard EN 10202: 2001).

Prior to anodic oxidation, the tin layer of the tinplate can optionally be partially melted by heating the tinplate to temperatures above the melting point of tin (232° C.). Preferably, the heating is inductive so that only a portion of the tin layer facing the steel substrate can be melted and metallic tin remains on the surface of the tin layer. The melted area of the tin layer forms an iron-tin alloy layer with the iron atoms of the steel substrate, which forms a barrier against corrosion.

The tinplate produced by the method according to the invention then has the following layer structure (in this sequence):

- Steel substrate (in particular a single-reduced (SR) or double-reduced (DR) cold-rolled steel sheet with a thickness of 0.5 mm or less),
- optional: iron-tin alloy layer, in particular with a coating weight in the range of 0.1 to 2 $g/m^2$ in terms of tin,
- free (metallic) tin, in particular with a coating weight in the range of 0.5 to 5 $g/m^2$,
- Tin oxide, especially from $SnO_2$ and especially with a charge density in the range of 10 to 30 $C/m^2$,
- chromium oxide-containing passivation layer, in particular with a coating weight in the range of 3 to 12 $mg/m^2$ in terms of chromium.

The chromium oxide passivation layer can be a pure chromium oxide layer, apart from unavoidable impurities. However, the passivation layer can also be composed of several superimposed layers of different composition, whereby the individual layers can contain metallic chromium, chromium oxides and/or chromium hydroxides and possibly chromium carbides and differ from one another in their chromium oxide content. In particular, the passivation layer may contain a lower layer of metallic chromium and chromium oxide/chromium hydroxide and optionally chromium carbides and an upper layer of pure chromium oxide. The individual layers of the passivation layer can thereby be deposited on the tin surface of the tinplate in the individual electrolytic tanks of the electrolysis system according to the invention arranged one behind the other, the individual electrolytic tanks being filled with an electrolyte solution of different composition and/or having different electrolyte temperatures. The differences in composition and/or temperature of the electrolyte solutions in the individual electrolyte tanks result in the different composition of the individual layers of the passivation layer.

The upper layer of the electrolytically deposited passivation layer expediently contains only chromium oxides and chromium hydroxides, the chromium hydroxides being converted into chromium oxides by the thermal treatment in the method according to the invention, so that the upper layer of the tinplate according to the invention, apart from unavoidable impurities and residual chromium hydroxides, after the thermal treatment consists at least essentially of pure chromium oxide.

The method according to the invention can therefore be used to produce tinplate with a chromium-oxide containing passivation layer, the passivation layer having at least one upper layer which consists essentially only of trivalent chromium oxides and in particular does not contain any chromium hydroxides apart from residual constituents. Preferably, at least the upper layer of the passivation layer has a chromium oxide content by weight of more than 95%, and more preferably of more than 98%. Preferably, the passivation layer or its upper layer contains at least substantially only compounds of chromium and oxygen in which the chromium is present in trivalent form, in particular as $Cr_2O_3$ and/or $Cr(OH)_3$.

Tinplate according to the invention is characterized by a high corrosion resistance, a good marbling resistance to sulfur-containing materials and good adhesion to organic coatings such as lacquers or polymer coatings.

In addition to chromium oxides and residues of chromium hydroxide, the passivation layer or its upper layer may, apart from unavoidable impurities, still contain residual chromium sulfate (as the starting chromium compound of the electrolytic deposition method if, for example, Cr-(III) sulfate is used as the trivalent chromium compound in the electrolytic solution).

In an advantageous embodiment, the passivation layer of the tinplate according to the invention is composed of at least a lower layer facing the surface of the tinplate and an upper layer forming the surface of the passivated tinplate, the lower layer containing metallic chromium as well as chromium oxide/chromium hydroxide and optionally chromium carbides and the upper layer consisting of pure chromium oxide, except for the said residual components of chromium hydroxide and chromium sulfate and other unavoidable impurities.

A good corrosion resistance of tinplate according to the invention can be achieved if the passivation layer has a total coating weight in terms of chromium of at least 3 $mg/m^2$, preferably from 5 $mg/m^2$ to 15 $mg/m.^2$

BRIEF DESCRIPTION OF THE DRAWINGS

Below, the invention is explained in more detail by means of embodiment examples with reference to the accompanying drawings, these embodiment examples explaining the invention by way of examples only and are not limiting it with respect to the scope of protection defined by the following claims. The drawings show:

FIGS. 1A and 1B: Schematic representation of two different embodiments of an electrolysis system according to the invention for carrying out the method according to the invention, wherein FIG. 1A shows a first embodiment with an electrolytic tank filled with a trivalent chromium electrolyte solution and FIG. 1B shows a second embodiment with two electrolytic tanks, each filled with a trivalent chromium electrolyte solution of different composition;

FIG. 2A shows an embodiment with a single-layer passivation layer and FIG. 2B shows an embodiment with a double-layer passivation layer;

FIG. 3: Shows the method and material parameters of the tested tinplate samples from the laboratory tests; and FIG. 4: Summarizes the results of the plant test.

DETAILED DESCRIPTION

Figure 1A:
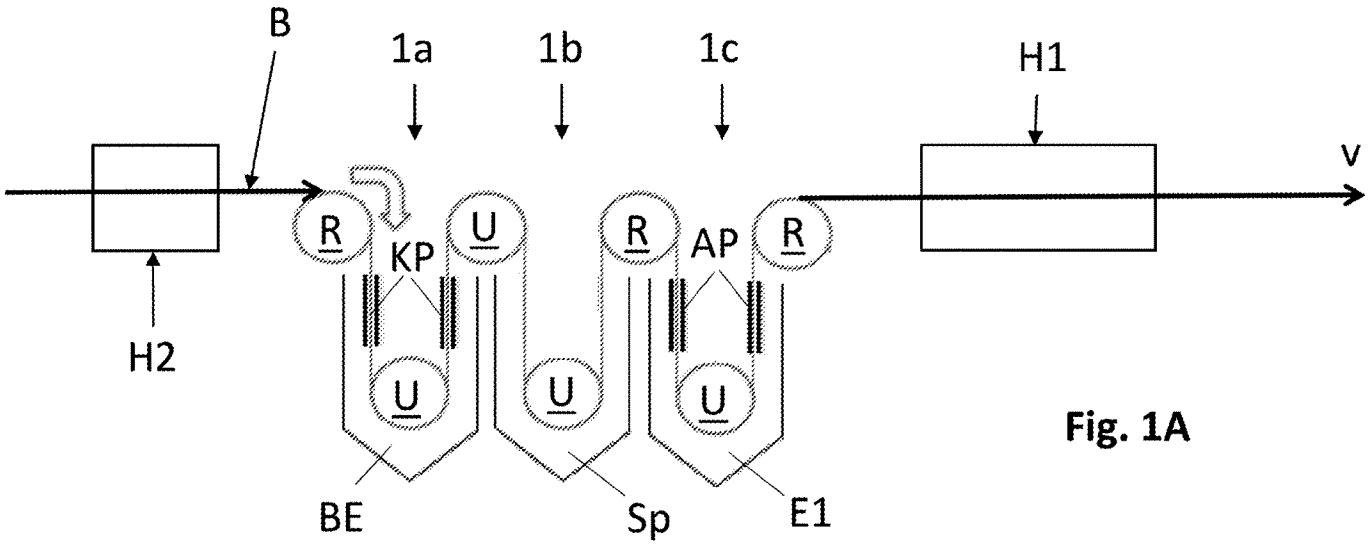
Figure 1B:
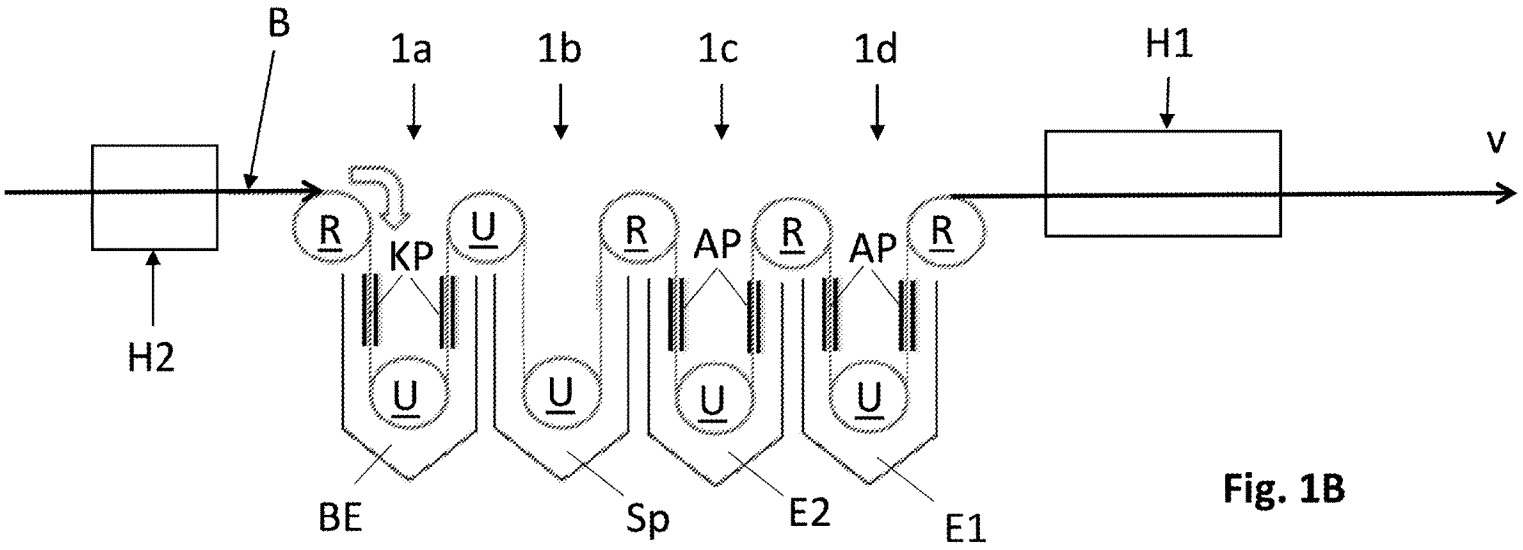

FIGS. 1A and 1B schematically show various embodiments of electrolysis systems for carrying out the method according to the invention. The electrolysis system of FIG. 1A comprises three tanks 1*a*, 1*b*, 1*c* arranged next to each other or one behind the other in a strip running direction, the first tank 1*a* being filled with a basic electrolyte BE, the middle tank 1*b* being filled with a rinsing solution Sp and the last tank 1*c* being filled with a first electrolyte solution E1.

The basic electrolyte BE consists of an aqueous soda solution (sodium carbonate solution with a concentration of 1 to 10 wt. % and a pH value of 10 to 11). The rinsing solution Sp consists of distilled or demineralized water.

The first electrolyte solution E1 is an aqueous solution of a trivalent chromium compound, which furthermore comprises a salt for increasing conductivity and an acid for adjusting a desired pH value between 2.5 and 3.5 and is free from organic complexing agents and buffering agents. In a preferred embodiment, the first electrolyte solution E1 consists of the trivalent chromium compound, in particular Cr-(III) sulfate, the salt (e.g. potassium sulfate or sodium sulfate), the acid (e.g. sulfuric acid) and water as solvent and otherwise has no other components. The first electrolyte solution E1 contains in particular no organic components, in particular no organic complexing agents such as formates and no buffering agents such as boric acid, and is free of halides. An example of the composition of the first electrolyte solution E1 is given in Table 1. The concentration of the trivalent chromium compound in the first electrolyte solution E1 is preferably at least 10 g/L and particularly preferably 20 g/L or more. The temperature of the first electrolyte solution E1 is preferably between 25° C. and 70° C.

A cathode pair KP is arranged in the first tank 1*a* and an anode pair AP is arranged in the last tank 1*c*. The anode pair AP is free of stainless steel and platinum and contains a coating of a metal oxide such as iridium oxide or a mixed metal oxide such as tantalum-iridium oxide. The anodes of the AP anode pair may also be made entirely of a metal oxide or a mixed metal oxide. Electric current may be applied to the cathodes of cathode pair KP and the anodes of anode pair AP.

A tinned steel strip (tinplate strip, hereinafter also referred to as strip B) is successively fed through the tanks 1*a*-1*c*. The strip B is drawn through the tanks 1*a*-1*c* by a transport device not shown here in a strip running direction v at a predetermined strip speed of preferably more than 100 m/min and in particular in the range from 100 to 750 m/min. Current rollers R are arranged above the tanks 1*a*-1*c*, via which the strip B can be switched as anode or cathode. In each electrolytic tank and above tanks 1*a*-1*c*, deflection rollers U are also arranged, around which the strip B is guided and thereby fed through tanks 1*a*-1*c*. The strip B is guided between the opposing cathodes of the cathode pair KP and between the two anodes of the anode pair AP.

A first heating device H1 is arranged downstream of the last tank 1*c* and a second heating device H2 is arranged upstream of the first tank. The heating devices H1 and H2 can each be a continuous furnace in which the strip B is heated to a predefinable temperature and held at this temperature for a holding time. The holding time is determined by the strip speed and the length of the continuous furnace. The heating devices H1 and H2 can preferably also contain induction coils for inductive heating of the strip. The first heating device H1 is arranged for rapid heating of the strip B to temperatures between 100° C. and 232° C. for a treatment time of at least 0.5 seconds. The second heating device H2 is set up for heating the strip B to temperatures above the melting point of tin (232° C.).

In preparation for the electrolysis method, strip B is first degreased, rinsed, pickled and rinsed again and then passed first through the second heating device H2, then successively through tanks 1*a*-1*c* and finally through the first heating device H1.

In the second heating device H2, the tin coating of the tinplate strip B is at least partially melted by heating to temperatures above the melting point of tin. The melting of the tin coating produces a dense iron-tin alloy layer at the interface of the steel sheet substrate and the tin coating of the tinplate, the composition of which depends on the temperature and which may contain FeSn and $FeSn_2$ or a mixture thereof. Preferably, the tin coating is only partially melted, leaving a layer of free metallic tin on the surface. This can be anodically oxidized in the first tank 1*a*.

For this purpose, the strip B in the first tank 1*a* is connected as anode and a current density in the range of 0.1 to 10 A/dm$^2$ and preferably between 0.2 and 3 A/dm$^2$ is generated by the cathode pair KP, depending on the strip speed. At a corresponding current density, a tin oxide layer consisting at least essentially of tetravalent tin oxide ($SnO_2$) forms on the tin surface of the tinplate due to electrolytic interaction with the basic electrolyte BE. The thickness of the tin oxide layer electrolytically generated in the first tank 1*a* depends on the strip speed and the current density. The first tank 1*a* can also be passed through without current, so that no (tetravalent) tin oxide layer is formed on the tin surface of the tinplate strip B.

Subsequently, the strip B is passed through the central tank 1*b* with the rinsing solution Sp in order to rinse the strip. This is followed by drying by means of a drying device not shown here.

In the following tank 1*c*, strip B is connected as a cathode and a current density of more than 15 A/dm$^2$, in particular in the range from 20 A/dm$^2$ to 40 A/dm$^2$, is generated by means of the anodes of the anode pair AP. At this current density, a passivation layer P containing chromium oxide is deposited on the (oxidized) surface of the tinplate strip B, which may contain chromium hydroxide and unavoidable impurities of chromium sulfate in addition to chromium oxide. The weight of the chromium oxide-containing layer can be controlled by the electrolysis time in the last tank 1*c*, which in turn can be controlled by the strip speed and the current density. With higher strip speeds, the minimum current density required for electrolytic deposition of a chromium oxide-containing layer increases. The electrolysis time in the last tank is between 0.5 and 2.0 seconds, depending on the strip speed. Preferably, in the last tank 1*c* a chromium oxide-containing passivation layer P is deposited on the (oxidized) surface of the tinplate strip B with a chromium-related coating weight of 3 to 12 mg/m$^2$.

The electrodeposited passivation layer P consists essentially of chromium oxide and chromium hydroxide and, in particular, has a proportion by weight of the chromium oxide and chromium hydroxide in terms of the total coating weight of the passivation layer of at least 90%, preferably more than 95%. In addition to chromium oxide and chromium hydroxide, the passivation layer may still contain unavoidable impurities, such as residual chromium sulfate, if Cr-(III) sulfate has been used as the chromium compound in the first electrolyte solution E1.

To minimize the amount of chromium hydroxide in the passivation layer, the passivated strip B is passed through the first heating device H1 and kept therein at treatment temperatures above 100° C., in particular in the range from 100° C. to 230° C., for a treatment time of at least 0.5 seconds. The treatment temperature should not exceed the melting point of tin (232° C.) to prevent melting of the tin layer. The treatment time depends on the strip speed and the length of the first heating device H1, which can be in the range of 3 m to 30 m. If induction heating is used, the length of the heating device can also be shorter. After the thermal treatment in the first heating device, the weight fraction of the chromium oxide in terms of the total coating weight of the passivation layer is preferably at least 95% and even more preferred exceeds 98%.

Figure 2B:
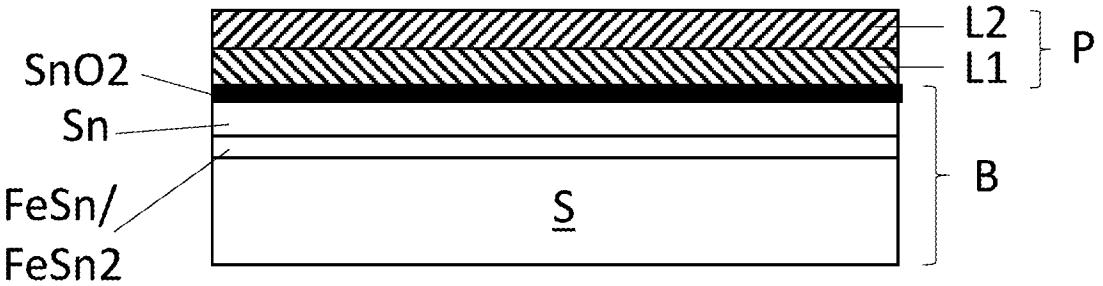
FIGS. 2A and 2B: Schematic sectional views of embodiments of tinplate according to the invention, where
Figure 2A:
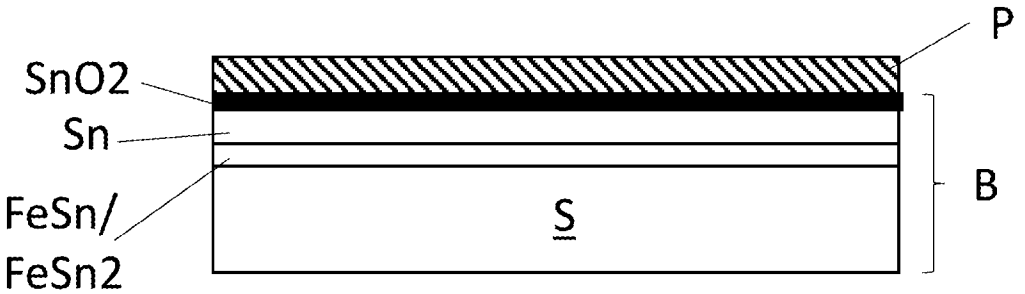

FIG. 2A schematically shows a sectional view of a tinplate strip B which can be produced with the electrolysis system of FIG. 1A. On one side of the strip B, which is composed of the steel sheet substrate S, the iron-tin alloy layer ($FeSn/FeSn_2$), the metallic tin layer (Sn) and the (tetravalent) tin oxide layer ($SnO_2$), the passivation layer P is applied, which consists essentially of pure chromium oxide The strip B can also be provided with a corresponding passivation layer P on both sides.

After thermal treatment in the first heating device H1, the strip B provided with the dried passivation layer P can be rinsed, dried and oiled (for example with DOS). After this, the passivated strip B can additionally be provided with an organic coating. The organic coating is applied to the surface of the chromium oxide passivation layer in a known manner, for example by lacquering or laminating a plastic film. The chromium oxide surface of the passivation layer provides a good adhesive base for the organic material of the organic coating. The organic coating can be, for example, an organic lacquer or a polymer film made of thermoplastic polymers such as PET, PE, PP or mixtures thereof. The organic coating can be applied, for example, in a coil coating method or in a sheet method, wherein the coated strip is first divided into sheets in the sheet method, which are then coated with the organic coating or laminated with a polymer film.

FIG. 1B shows a second embodiment of an electrolysis system containing four tanks 1*a*, 1*b*, 1*c*, 1*d* arranged one behind the other in the running direction of the strip. The two front tanks 1*a*, 1*b*, viewed in the running direction of the strip, correspond to tanks 1*a* and 1*b* of the embodiment of FIG. 1A and are filled with the basic electrolyte BE and the rinsing solution Sp. Downstream of the second tank 1*b* is a third tank 1*c*, which is filled with a second electrolyte solution E2. Adjacent to the third tank 1*c* in the strip running direction v is a fourth tank 1*d*, which is filled with the first electrolyte solution E1. Examples of the composition of the first electrolyte solution E1 and the second electrolyte solution E2 are given in Table 1.

TABLE 1

| Component | Concentration |
|---|---|
| Chromium sulfate | 120 g/L |
| Sodium sulfate | 100 g/L |
| diluted sulfuric acid 96% | 7 ml/L |
| Deionized water | Rest |

The composition of the first and second electrolyte solutions E1, E2 differs in that the first electrolyte solution E1 (as in the embodiment of FIG. 1A) is free of organic components and in particular free of organic complexing agents, whereas the second electrolyte solution E2 contains organic complexing agents in addition to the trivalent chromium compound, a conductivity-increasing salt, an acid and water as the solvent. In particular, formates, for example sodium or potassium formate, are used as organic complexing agents.

Due to the different composition of the electrolyte solutions E1 and E2 filled in the two downstream tanks 1*c* and 1*d*, layers containing chromium oxide are electrolytically deposited on the surface of the tinplate strip B in these last two tanks 1*c* and 1*d*, which differ from each other in terms of their composition. Here, in tank 1*c*, a lower layer L1 of a passivation layer P is deposited from the second electrolyte solution E2, and in the last tank 1*d*, an upper layer L2 is deposited from the first electrolyte solution E1. The lower layer L1 deposited in tank 1*c* from the second electrolyte solution E2 contains chromium oxide/chromium hydroxide as well as metallic chromium and chromium carbides. The upper layer L2, on the other hand, consists essentially of chromium oxide/chromium hydroxide. The proportion by weight of chromium oxide and chromium hydroxide is therefore lower in the lower layer L1, which is deposited in the upstream tank 1*c*, than in the upper layer L2, which is deposited on the surface of the tinplate strip B in the last tank 1*d*, viewed in the strip running direction. The passivation layer P deposited in the last two tanks 1*c*, 1*d* is therefore composed of a lower layer L1 facing the steel sheet substrate S and an upper layer L2 deposited thereon, the composition of the lower and upper layers differing in terms of the weight fraction of chromium oxide and chromium hydroxide and of metallic chromium and chromium carbide. In particular, the upper layer L2 has a higher weight fraction of chromium oxide/chromium hydroxide and does not contain metallic chromium. In the lower layer, a weight fraction of 10% to 50% can be attributed to metallic chromium and the remainder to chromium oxide/chromium hydroxide and chromium carbide.

FIG. 2A schematically shows a sectional view of a tinplate strip B with a passivation layer P which can be produced with the electrolysis system of FIG. 1B. Compared with the embodiment of FIG. 2A, the passivation layer P on the surface of the passivated tinplate strip is composed of two layers, namely the lower layer L1 and the upper layer L2, which differ from one another in terms of composition and, in particular, the proportion by weight of chromium metal and chromium oxide/chromium hydroxide, with a higher proportion by weight of chromium oxide/chromium hydroxide in the upper layer L2.

As in the embodiment of FIG. 1A, in the electrolysis system of FIG. 1B, after the passivation layer P has been applied to the surface of the tinplate strip B, a thermal treatment is carried out in the first heating device H1 in order to remove the chromium hydroxides from the passivation layer P and in particular from the upper layer L2 by drying and conversion into chromium oxides. After the thermal treatment, at least the upper layer L2 consists essentially of pure chromium oxide, apart from unavoidable impurities, the percentage by weight of chromium oxide in terms of the total coating weight of the passivation layer P being at least 95% and preferably more than 98%.

EXAMPLES

Example 1

In order to determine the growth of tin oxide on the tin surface of passivated tin sheets which have been electrolytically coated with a passivation layer containing chromium oxide on the basis of an electrolyte solution containing a trivalent chromium compound, tin sheets were passivated in the laboratory by electrolytic deposition of a passivation layer containing chromium oxide and then subjected to a thermal treatment in accordance with the invention. Subsequently, the samples were stored in an oxygen-containing atmosphere (air) in a climate chamber at 40° C. and a humidity of 80% for a period of 6 weeks. Before the beginning and during the storage period, the amount of tin oxide layer formed on the tin surface of the tinplate samples due to oxidation with atmospheric oxygen was recorded. The amount of tin oxide layer formed by oxidation to atmospheric oxygen was determined coulometrically.

For comparison, the same samples without a thermal treatment were exposed to the same storage conditions in the climate chamber after the electrolytic deposition of the passivation layer P, and the amount of tin oxide formed on the tin surface of the tinplate samples by oxidation with atmospheric oxygen before and during storage was also recorded coulometrically on these comparative samples.

The method and material parameters of the tested tinplate samples from the laboratory tests are shown in Table 2 (FIG. 3).

To prepare the specimens, partially melted, unpassivated tinplate specimens with a tin coating of 1.4 g/m$^2$ on both sides were cathodically degreased after cathodic degreasing for an anodizing time of 30 seconds at a current density of 2.5 A/dm$^2$ in a 5-percentage soda solution and then rinsed with fully demineralized water. After cathodic degreasing at a current density of 2 A/dm$^2$, the tinplate samples were then electrolytically provided with a chromium-oxide containing passivation layer P by applying to the tinplate samples from the first electrolyte E1 from Tab. 1, the pH of which was adjusted to pH=3.2 by the addition of sulfuric acid, at a temperature of 35° C. for an electrolysis time of 0.5 to 1.0 seconds. The coating weight in terms of chromium of the electrolytically deposited passivation layer P is given in Table 2 as "chromium support (Cr)".

The tinplate samples provided with the passivation layer P were then subjected to a temperature of 200° C. in a furnace for 600 seconds for a thermal treatment in accordance with the invention. This thermal treatment was not carried out on the comparative specimens (specimen nos. 1a, 1b, 2a, 2b, 3a and 4a) in Table 2.

Thereafter, the samples thermally treated according to the invention and the comparison samples were stored for 6 weeks in the climate chamber in the presence of atmospheric oxygen at 40° C. and 80% humidity. At the beginning of storage and at 2-week intervals, the amount of tin oxide layer ($SnO_2$) formed on the tin surface of the tinplate samples during the respective storage period was determined coulometrically. Table 2 shows the initial amounts of tin oxide layer ($SnO_2$) that were present on the surface before the samples were placed in the storage and the amounts of tin oxide layer ($SnO_2$) that were recorded after storage periods of 2, 4, and 6 weeks. The last column of Table 2 shows the difference between the amount of tin oxide layer ($SnO_2$) after six weeks of storage in the climate chamber and the initial amount of tin oxide layer ($SnO_2$).

From the last column of Table 2, it can be seen that the samples according to the invention (samples 1c, 2c, 3b and 4b), in which the thermal treatment according to the invention has been carried out after the electrolytic deposition of the passivation layer P, show a significantly lower growth of tin oxide compared to the reference samples (samples 1a, 1b, 2a, 2b, 3a and 4a), in which no thermal treatment has taken place. Accordingly, the thermal treatment of the passivated tinplate samples according to the invention leads to a significant reduction in tin oxide growth in an oxygen-containing atmosphere when the tinplate samples are stored for a longer period of time. In comparison, an inhibition of tin oxide growth of more than 50% can be seen in the samples treated according to the invention compared with the reference samples.

Example 2

In a plant test, tinplate strips with a tin coating of 2.4 g/m$^2$ on both sides were passed through an electrolysis system of the type shown in FIG. 1A at a strip speed of 300 m/min. The electrolyte tanks were filled with the electrolyte E1 from Table 1. In the second heating device H2, the tin layer was partially melted and the first tank 1*a* was passed through without current, i.e. no anodic oxidation of the tin surface was carried out. In the last tank 1*c*, a passivation layer P containing chromium oxide was deposited electrolytically on the tin surface of the tinplate strip with a coating weight (chromium support) of about 9 mg/m$^2$ in terms of chromium. After deposition of the passivation layer, the tinplate samples according to the invention (samples Nos. 2 to 5 from Table 3 (FIG. 4)) were cooled to room temperature and thermally treated in the first heating device H1 for different treatment times ranging from 10 seconds to 120 seconds at a treatment temperature of 187° C. The first heating device H1 was used to heat the tinplate samples. This thermal treatment was not carried out on a comparative sample (Sample No. 1 from Table 3). The tinplate strip was then cut into sheets and the initial amount of tin oxide on the tin surface of the samples thus produced was recorded coulometrically. The tinplate samples were stored for 4 weeks in a climate chamber at 40° C. and 80% humidity in air and the amount of tin oxide formed on tin surface of the samples during storage due to oxidation with atmospheric oxygen was recorded coulometrically at 2-week intervals.

Table 3 summarizes the results of the plant test. The comparative sample (sample no. 1) shows a tin oxide ($SnO_2$) occupancy of 11 C/m$^2$ on the tin surface at the beginning of the climate chamber storage and this oxide occupancy has increased to 44 C/m$^2$ after 2 weeks and to 60 C/m$^2$ after 4 weeks.

In contrast, the tinplate samples thermally treated according to the invention (samples Nos. 2 to 5 from Table 3) show a lower tin oxide layer already at the beginning of the climate chamber storage and the growth of the tin oxide layer during storage in the climate chamber is significantly lower for the samples according to the invention, whereby the inhibition of the tin oxide growth is higher with longer treatment time. For example, Samples Nos. 4 and 5, which have been thermally treated at 187° C. for a treatment time of 60 seconds (Sample No. 4) and 120 seconds (Sample No. 5), respectively, exhibit a tin oxide overlay of less than 40

$C/m^2$ after four weeks of storage in the climate chamber. Such tin oxide overlays of less than 40 $C/m^2$ are preferred both visually and in terms of lacquer adhesion and paintability. Tinplate with tin oxide coatings between 41 $C/m^2$ and 69 $C/m^2$ exhibit sufficient adhesion for organic coatings, but have a pale yellowish discolored surface and are therefore not optimal. Tin oxide coatings above 69 $C/m^2$ can lead to complete failure of the material and in particular to detachment of the organic coating due to insufficient adhesion to the surface of the passivated tinplate.

The method according to the invention can significantly reduce tin oxide growth on the tin surface of tinplate that has been electrolytically passivated from a trivalent chromium electrolyte, resulting in better adhesion of organic coatings and a pleasing visual appearance of the surface.

The invention claimed is:

1. A method for passivating a surface of a tinplate, the method comprising:

electrolytically depositing a passivation layer on the surface of the tinplate, the passivation layer including at least one of chromium oxide and chromium hydroxide, in which the electrolytic deposition of the passivation layer is effected at least partially by an electrolyte solution which contains a trivalent chromium compound, at least one salt for increasing conductivity, at least one acid or one base for adjusting a desired pH value, is free from organic complexing agents, and is free from buffering agents, and removing chromium hydroxide from the passivation layer by thermally treating the passivated tinplate within an intermediate time after the electrolytic deposition of the passivation layer, thermally treating including keeping the passivated tinplate at a treatment temperature of between 100° C. and 232° C. for a treatment time of between 0.5 seconds and 30 minutes, and wherein the intermediate time is 10 seconds or less between completion of the electrolytic deposition of the passivation layer on the surface of the tinplate and reaching of the treatment temperature by the passivated tinplate, and wherein the passivation layer, after completion of the treatment time, consists essentially of pure chromium oxide.

2. The method according to claim 1, wherein thermally treating includes inductive heating of the passivated tinplate to the treatment temperature.

3. The method according to claim 1, wherein the electrolyte solution has an average temperature in a range from 20° C. to 80° C. and the passivated tinplate, immediately after completion of the electrolytic deposition of the passivation layer, has a tinplate temperature equivalent to an average temperature of the electrolyte solution and in thermally treating the passivated tinplate is heated to the treatment temperature starting from the tinplate temperature.

4. The method according to claim 1, wherein the passivated tinplate is heated to the treatment temperature at a heating rate of 100 to 700 K/s within the intermediate time after completion of the electrolytic deposition of the passivation layer.

5. The method according to claim 1, wherein the electrolyte solution consists of the trivalent chromium compound, the at least one salt, the at least one acid or base, and a solvent.

6. The method according to claim 1, wherein, after completion of the treatment time, the passivation layer has a weight fraction of chromium oxide of more than 95% and a remainder of the passivation layer is formed by unavoidable by-products including chromium sulfate.

7. The method according to claim 1, wherein for the electrolytic deposition of the passivation layer, the tinplate is passed at a speed in a running direction through at least one electrolyte tank or through a plurality of electrolyte tanks arranged one behind another in the running direction, the speed between 100 m/min and 900 m/min.

8. The method according to claim 7, wherein the tinplate is passed through the plurality of electrolyte tanks arranged one behind another in the running direction and wherein an electrolysis time, in which the tinplate is electrolytically effectively in contact with the electrolyte solution, is less than 1.0 second in at least one electrolyte tank of the plurality of electrolyte tanks and a total electrolysis time, during which the tinplate is in electrolytically effective contact with the electrolyte solution in all electrolyte tanks, is between 0.5 seconds and 2.0 seconds.

9. The method according to claim 7, wherein the tinplate is passed through the plurality of electrolyte tanks arranged one behind another in the running direction and wherein at least a last electrolyte tank of the plurality of electrolyte tanks, as viewed in the running direction, contains an electrolyte solution which consists of the trivalent chromium compound, the at least one salt, the at least one acid or base, and a solvent.

10. The method according to claim 1, wherein the passivation layer applied, in the electrolytic deposition, from the electrolyte solution has a total coating weight of at least one of chromium oxide and chromium hydroxide between 3 $mg/m^2$ and 12 $mg/m^2$ in terms of chromium.

11. The method according to claim 1, wherein a tin oxide layer consisting essentially of tetravalent tin oxide ($SnO_2$) is developed on the surface of the tinplate prior to the electrolytic deposition of the passivation layer on the surface of the tinplate by placing the tinplate as an anode in an aqueous electrolyte containing a phosphate, borate, sulfate, or carbonate.

12. The method according to claim 7, wherein the tinplate is passed through the at least one electrolyte tank and wherein an electrolysis time, in which the tinplate is electrolytically effectively in contact with the electrolyte solution, is between 0.5 seconds and 2.0 seconds.

13. A method for electrolytically passivating a surface of a tinplate strip by depositing a passivation layer on the surface of the tinplate strip, the passivation layer containing at least one of chromium oxide and chromium hydroxide, the method comprising:

transporting the tinplate strip in a running direction at a predetermined speed through at least one electrolyte tank containing at least one anode and filled with an electrolyte solution containing a trivalent chromium compound, at least one salt for increasing conductivity, and at least one acid or one base for adjusting a desired pH value, the electrolyte solution free from organic complexing agents and buffering agents;

connecting the tinplate strip as a cathode and generating a predefined current density between the tinplate strip acting as the cathode and the at least one anode contained in the at least one electrolyte tank, thereby obtaining a passivated tinplate strip by depositing the passivation layer from the electrolyte solution on the surface of the tinplate strip; and removing chromium hydroxide from the passivation layer by exposing the passivated tinplate strip to a heat treatment in a heating device arranged downstream of the at least one electrolyte tank as viewed in the running direction, wherein the heat treatment includes heating the passivated tinplate strip within an intermediate time of 10 seconds or less between completion of the electrolytic deposition of the passivation layer on the surface of the tinplate strip and reaching a predetermined treatment temperature between 100° C. and 232° C. and holding the tinplate strip for a predetermined treatment time between 0.5 seconds and 30 minutes at the predetermined treatment temperature, and wherein the passivation layer, after completion of the predetermined treatment time, consists essentially of pure chromium oxide.

14. A method for electrolytically passivating a surface of a tinplate strip by depositing a passivation layer on the surface of the tinplate strip, the passivation layer containing at least one of chromium oxide and chromium hydroxide, the method comprising:

transporting the tinplate strip in a running direction at a predetermined speed through a plurality of electrolyte tanks arranged in series, wherein each electrolyte tank of the plurality of electrolyte tanks contains at least one anode and at least one electrolyte tank of the plurality of electrolyte tanks is filled with a first electrolyte solution and remaining electrolyte tanks in the series are filled with the first electrolyte solution or with a second electrolyte solution, wherein the first electrolyte solution contains a trivalent chromium compound, at least one salt for increasing conductivity, and at least one acid or one base for adjusting a desired pH value, the first electrolyte solution is free from organic complexing agents and buffering agents and wherein the second electrolyte solution contains a trivalent chromium compound and has a different composition as compared to a composition of the first electrolyte solution;

connecting the tinplate strip as a cathode and generating a predefined current density between the tinplate strip acting as the cathode and the anodes contained in each electrolyte tank of the plurality of electrolyte tanks and thereby depositing the passivation layer from at least one of the first electrolyte solution and the second electrolyte solution on the surface of the tinplate strip to obtain a passivated tinplate strip; and removing chromium hydroxide from the passivation layer by exposing the passivated tinplate strip to a heat treatment in a heating device arranged downstream of the plurality of electrolyte tanks as viewed in the running direction, wherein the heat treatment includes a heating of the passivated tinplate strip within an intermediate time of 10 seconds or less between completion of the electrolytic deposition of the passivation layer on the surface of the tinplate strip and reaching a predetermined treatment temperature of between 100° C. and 232° C. and holding the passivated tinplate strip for a predetermined treatment time of between 0.5 seconds and 30 minutes at the predetermined treatment temperature, and wherein the passivation layer, after completion of the predetermined treatment time, consists essentially of pure chromium oxide.

* * * * *